US005467800A

United States Patent [19]

Sallas

[11] Patent Number: 5,467,800

[45] Date of Patent: Nov. 21, 1995

[54] LOW INERTIA SERVO VALVE

[75] Inventor: John J. Sallas, Plano, Tex.

[73] Assignee: Atlas Fluid Controls Inc., Houston, Tex.

[21] Appl. No.: 337,137

[22] Filed: Nov. 10, 1994

Related U.S. Application Data

[63] Continuation of Ser. No. 170,635, Dec. 21, 1993, abandoned, which is a continuation of Ser. No. 49,950, Apr. 20, 1993, abandoned.

[51] Int. Cl.[6] ..... F15B 13/044

[52] U.S. Cl. ..... 137/625.65; 91/39; 91/467; 137/624.13; 137/625.23; 137/625.24

[58] Field of Search ..... 91/39, 467; 137/624.13, 137/625.23, 625.24, 625.65

[56] References Cited

U.S. PATENT DOCUMENTS

| | | | |
|---|---|---|---|
| 2,893,357 | 7/1959 | Clarke | 137/625.65 X |
| 3,810,417 | 5/1974 | Sieke | 91/39 |
| 4,442,755 | 4/1984 | Rozycki | 91/39 |
| 4,593,719 | 6/1986 | Leonard . | |
| 4,977,816 | 12/1990 | Kuttruf | 91/375 |
| 5,014,748 | 5/1991 | Nogami et al. . | |

FOREIGN PATENT DOCUMENTS

| | | | |
|---|---|---|---|
| 2516154 | 10/1976 | Germany | 137/625.24 |
| 707440 | 4/1954 | United Kingdom | 137/625.23 |
| 2104249 | 3/1983 | United Kingdom | 137/625.24 |

*Primary Examiner*—Gerald A. Michalsky
*Attorney, Agent, or Firm*—William A. Knox

[57] ABSTRACT

A rotary servo valve includes a valve body having a longitudinal bore therethrough. A sleeve fits into the bore. The wall of the sleeve is perforated by two groups of port openings, each group includes a plurality of sets of radially-disposed ports. In each group, the central longitudinal axis of one set of ports is radially displaced from the central longitudinal axis of one other set of ports by a preselected angular displacement. At least a third set of ports in one group is in continuous fluid communication with a source of pressurized fluid; at least a third set of ports in the other group in continuous fluid communication with a return sump. A hollow rotary control member consists of two internal chambers. Each chamber includes a number of sets of apertures that are radially disposed around the walls of the chambers, spaced-apart by a preselected angular separation. A torque motor means is furnished to rotate the control member between two opposite angular positions with respect to a null position, thereby to apply power to cause a hydraulic actuator to operate in a desired manner.

7 Claims, 7 Drawing Sheets

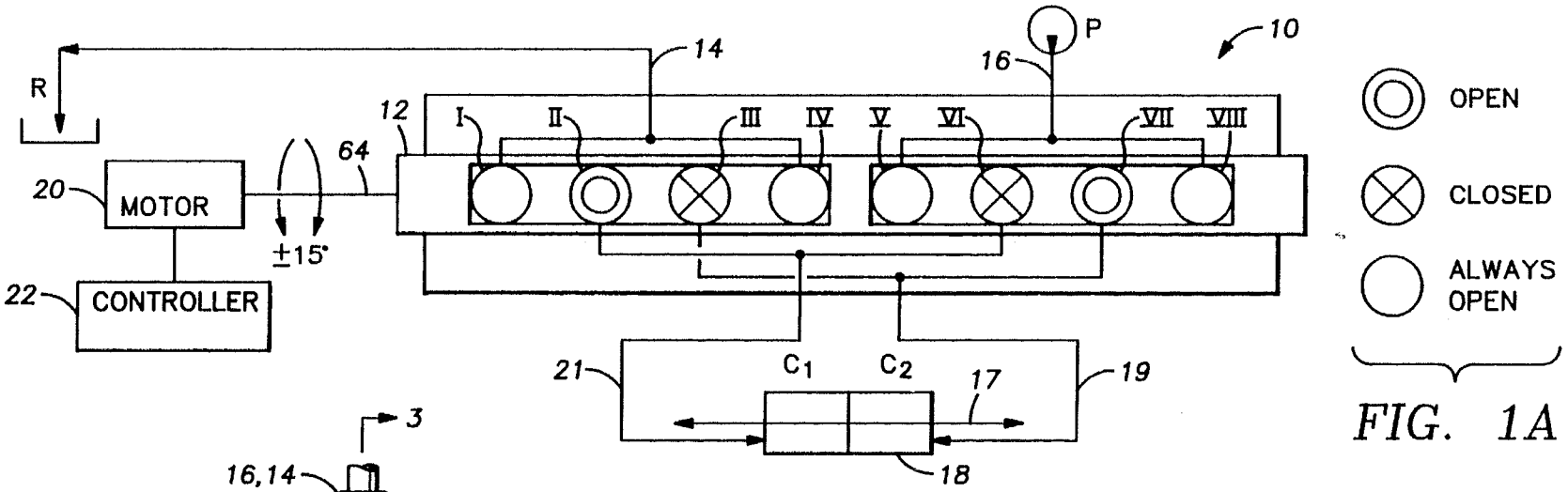
FIG. 1A
FIG. 1
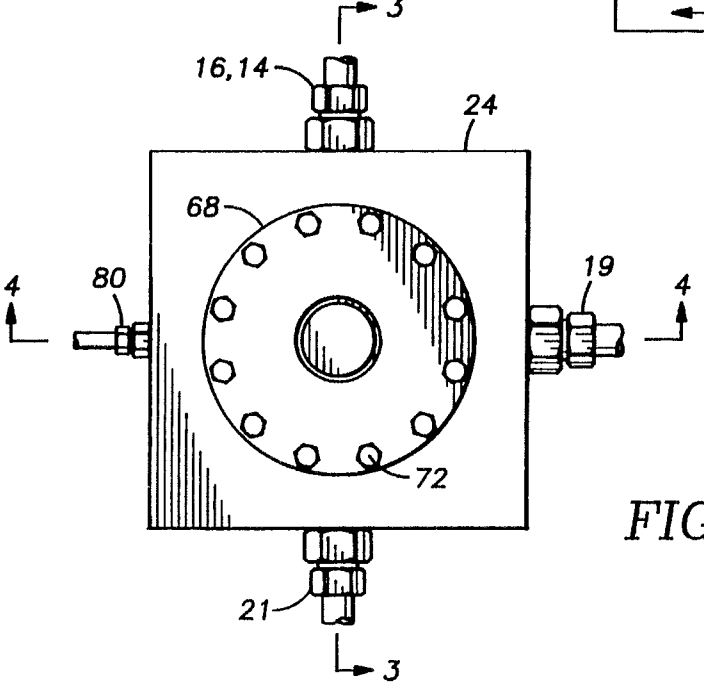
FIG. 2

LOW INERTIA SERVO VALVE

RELATION TO OTHER APPLICATIONS

This is a continuation of U.S. patent application Ser. No. 08/170,635, filed Dec. 21, 1993 in the name of J. Sallas, now abandoned, which is a continuation of U.S. patent application Ser. No. 08/049,950 filed Apr. 20, 1993 in the name of J. Sallas, now abandoned.

BACKGROUND OF THE INVENTION

1. Field of the Invention

This invention is concerned with a four-way rotary proportional servo valve wherein the valving mechanism is characterized by low inertia and balanced axial forces.

2. Discussion of Related Art

Servo valves are used to control the operation of hydraulic devices such as fluid-driven bi-directional linear actuators. The servo system may be as simple as a manually-operated spool valve for delivering hydraulic fluid to one or the other of two input ports of the actuator at an operating frequency of one cycle per minute or less. Here, the operator himself (herself) comprises the feedback loop and the system delay time is a function of the actuator loading and the operator's personal reaction time. On the other hand, the valve-control system may encompass a sophisticated programmed closed-loop feedback control employing high gain and negative feedback operating at hundreds of cycles per second. For low-frequency applications such as an hydraulically-powered earth mover or a backhoe, the servo-system response time is of little concern. In more complex systems that employ high flow rates, multistage valves are used. Multistaging introduces unwanted system delays that may lead to instabilities at high frequencies.

In a seismic exploration survey, a hydraulic vibrator, coupled to a ground-contacting base plate, is used to shake the ground at designated stations thereby to inject a powerful chirp signal into the earth at each of those stations. The frequency of the chirp signal ranges from about 5 Hz to about 160 Hz or more over a time span on the order of eight to sixteen seconds. More than one vibrator is normally used at each station during the progress the seismic survey. It is essential that the vibrator output signals of the respective vibrators must be accurately synchronized within less than a millisecond in high resolution geophysical surveys.

A typical well-known spool-type servo valve used by the seismic exploration community is described in U.S. Pat. No. 4,593,719 issued Jun. 10, 1986 to W. B. Leonard. Although this valve is an industry standard, problems arise at high frequencies by reason of the mass of the valve spool.

In an effort to evade the problems of inertia that plague spool-type servo valves, rotary servo valves have been developed. In that type of valve, a rotating orifice plate periodically interrupts the fluid flow from a source, through a distributor which directs the flow alternately between the two pressure inputs of an actuator. The angular velocity of the orifice plate controls the frequency. Because the orifice plate always rotates in one direction, the inertial effect presumably does not arise provided the angular velocity remains constant.

One type of rotary valve is disclosed in U.S. Pat. No. 4,442,755, issued Apr. 17, 1984, to Marek L. Rozycki, for a Power Stage Servo Valve for a Seismic Vibrator. The valve includes a relatively large-diameter rotatable orifice plate and a stationary orifice plate. The configuration of the orifices is such that the valve opens more quickly than it shuts off when the orifice plate rotates in one direction at a desired angular frequency. If the orifice plate were to rotate at a constant angular velocity, and hence interrupt the fluid flow at a constant frequency throughout a duty cycle, the inertia problem would not exist. among the problems with the Rozycki valve are first, that it cannot implement a pseudo-random sweep. Second, the orifice shapes a optimized for a particular loading and thus is not very flexible in its application.

As is well known in the art, inertial forces increase as the fourth power of the diameter of a rotary throttling device. A smaller diameter for the control member would dramatically reduce the inertial forces. U.S. Pat. No. 4,977,816 issued on Dec. 18, 1990 to W. Kuttruf for a Hydraulic Motor Control System with a Rotating Servo Valve provides a rotary valve which employs a rotating piston. The piston is in the form of a rod along which are cut axially disposed recesses on the outer surface of the rod. Although the diameter of the control member has been reduced substantially as compared to the Rozycki device, the recesses provide fluid passageways whose cross-sectional area is severely restricted such that the volume of fluid flow per unit time is inadequate for a seismic vibrator where flow rates in excess of 100 gallons per minute at systems pressures of 3000 psi are commonplace. The fluid flow restriction could be reduced by making the recesses deeper but that would be at the expense of reducing the torsional stiffness of the rotating piston. In high-frequency-response duty cycles, torsional resonances that lie within the useful seismic frequency band create stability problems, introduce spurious seismic responses due to unwanted signal resonances and lead to mechanical fatigue with ultimate failure of the valve.

U.S. Pat. No. 5,014,748, issued May 14, 1991 to T. Nogami, teaches a rotary valve in which a motor drives a disk inside of a casing. The relative position of the disk slots and the casing slots determine the opening area of the control orifices. This technology, while perhaps able to provide reasonable response time in low flow valves, the mechanism does not scale. In high flow applications where rapid response is critical, the inertia load for a disk becomes the limiting factor. The moment of inertia for a disk increases as the radius raised to the fourth power as earlier mentioned. For a disk sturdy enough not to deform under high pressure situations, the disk cannot be made arbitrarily thin. Therefore, higher power may be required to accelerate the valve having the geometry disclosed in the '748 patent than the rotary valve of this invention next to be described.

There is a need for an economical, high-frequency-responsive, low-inertia servo valve that will be mechanically stable, that will provide a high fluid-flow rate with a pressure drop less than about 1000 psi and that will be characterized by a robust mechanical design.

SUMMARY OF THE INVENTION

The servo valve of this invention includes a valve body through which is drilled a cylindrical bore. A plurality of annular chambers encircle the bore, spaced-apart axially along the bore, provide means for fluid communication between a fluid pressure source, a return and first and second input ports of a hydraulic motor or a hydraulic actuator. A cylindrical sleeve is mounted within the bore. The sleeve includes a plurality of sets of radially-distributed ports that open into the annular chambers. The ports have preselected dimensions and are distributed axially along the sleeve at selected positions so as to correspond with the locations of the respective annular chambers encircling the bore. A substantially hollow fluid-flow control member is rotatably mounted within the sleeve. The control member includes two separate internal chambers that are closed at each end. A plurality of sets of apertures having preselected dimensions provide fluid communication with the internal chambers. The axial distribution of the respective aperture sets along the control member correspond to the axial distribution of the ports in the sleeve. The apertures within each set are distributed radially around the control member. A control member drive means is provided for rotatably reciprocating the control member at a desired frequency between a first angular position and a second angular position through a null position.

In an aspect of this invention, the plurality of sets of ports distributed along the sleeve is divided into a first group and a second group, each group comprising at least three sets of ports. The radial orientation of the central longitudinal axes of a first set of ports within each group is rotated by a preselected angular displacement with respect to the radial orientation of the central longitudinal axis of a second set of ports in each group.

In a further aspect of this invention the ports comprising the third set of ports in each group are dimensioned such that the radial dimensions of each port of the third set of ports in each group subtends an arc that is of a length sufficient to ensure unrestricted fluid flow through the third set control-member apertures as the control member rotates between first and second angular positions.

In yet another aspect of this invention, the plurality of sets of apertures in the control member are divided into two groups of at least three sets of apertures each. The central longitudinal axes of first and second sets of apertures of each of the sets of apertures are in angular alignment with one another. The preselected dimensions of said apertures are substantially the same as the preselected dimensions of the corresponding ports the sleeve.

In an alternative arrangement, the central longitudinal axes of the ports in the sleeve are in angular alignment, the central longitudinal axes of the first set of apertures of each group are radially displaced with respect to the central longitudinal axes of the second set of apertures by a preselected angle.

In another feature of this invention the control member drive means is a programmable bi-directional torque motor for angular positioning of the control member at a desired rate over a continuous range of values lying between two discrete positions of a preselected angular position but of opposite angular direction relative to a central null position.

BRIEF DESCRIPTION OF THE DRAWINGS

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention:

FIG. 1 is a schematic diagram of the hydraulic circuits of the rotary servo valve;

FIG. 1A defines the meanings of the symbols used in FIG. 1;

FIG. 2 is an exterior end view of the valve of this invention;

DETAILED DESCRIPTION OF THE PREFERRED EMBODIMENT

Figure 3:
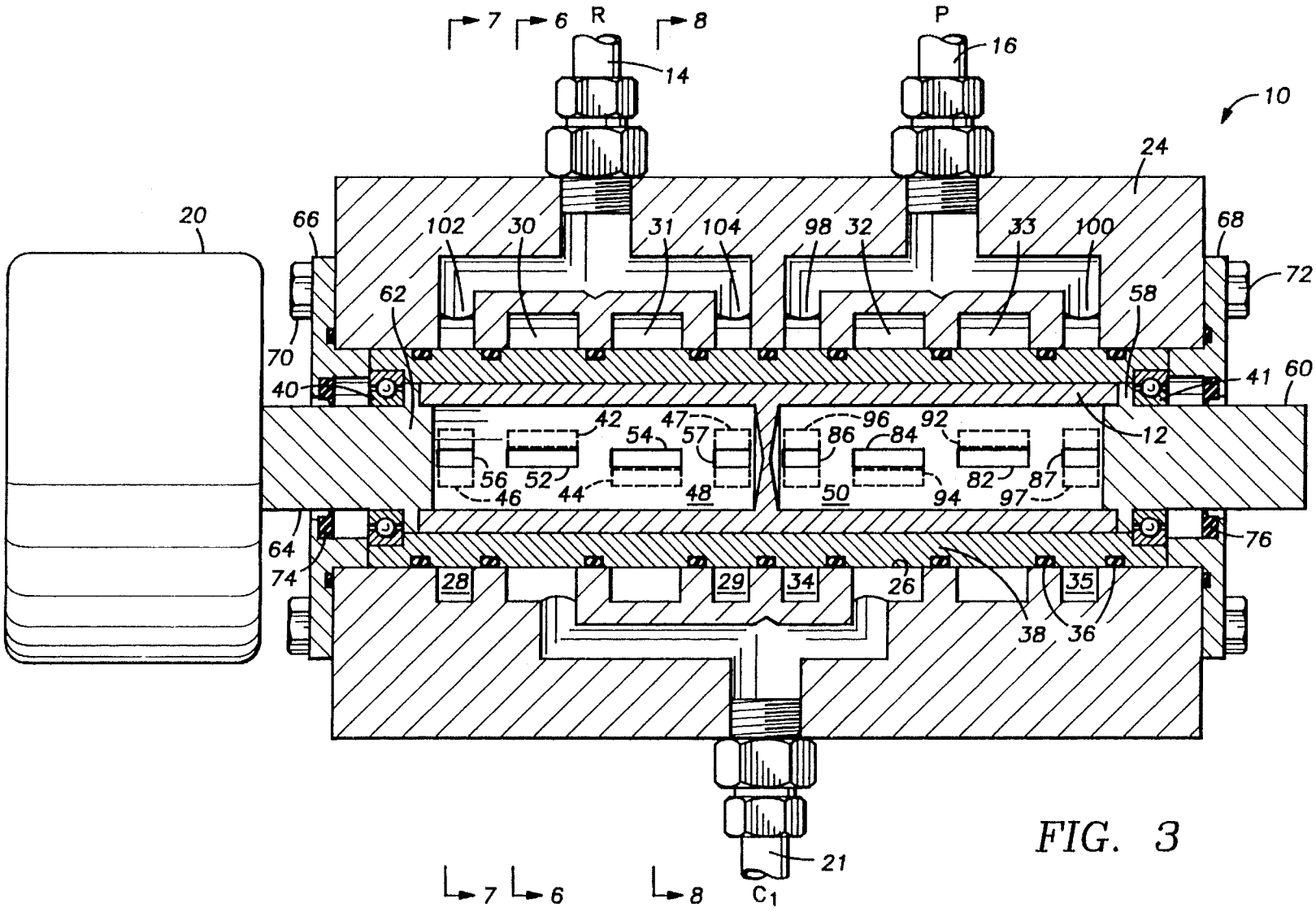
FIG. 3 is a detailed drawing of the structure of the essential parts of the servo valve along line 3—3 of FIG. 2.

FIG. 1 is a schematic diagram of the hydraulic circuitry, herewith presented to explain briefly the principles of operation of the low inertia rotary servo valve 10 of this invention. In its simplest form, the valve 10 of FIG. 1 includes eight sets of ports, identified by Roman numerals I–VIII, divided into two groups of four sets each. A rotary control member, indicated symbolically by 12, when in a first angular position, opens ports II and VII and closes ports III and VI. Ports I, IV and V, VIII are always open to return 14 and pressure source 16 respectively regardless of the angular position of the control member. FIG. 1A lists the symbols used in FIG. 1. With the control member 12 in the first angular position with ports II and VII open, as shown in FIG. 1, the piston 17 of actuator 18 will be urged to the left. When the rotary control member is rotated to the opposite angular position, ports II and VII will be closed with ports III and VI open, thereby to urge piston 17 to the right. The control member 12 is rotated to an angular position that may be either clockwise or counterclockwise from a central null position by a suitable motor 20 of any desired type which may be programmably actuated by any desired programming means 22 for rotatably driving the motor 20 at a desired angular frequency over a continuous range of angles that lie between two predetermined angular values.

FIG. 2 shows the external configuration of the valve body looking from the right hand end. Explanation of the various parts shown will be developed in connection with later views of the valve configuration. The valve body 24 is shown as rectangular by way of example but it could just as well be circular or oval.

Figure 4:
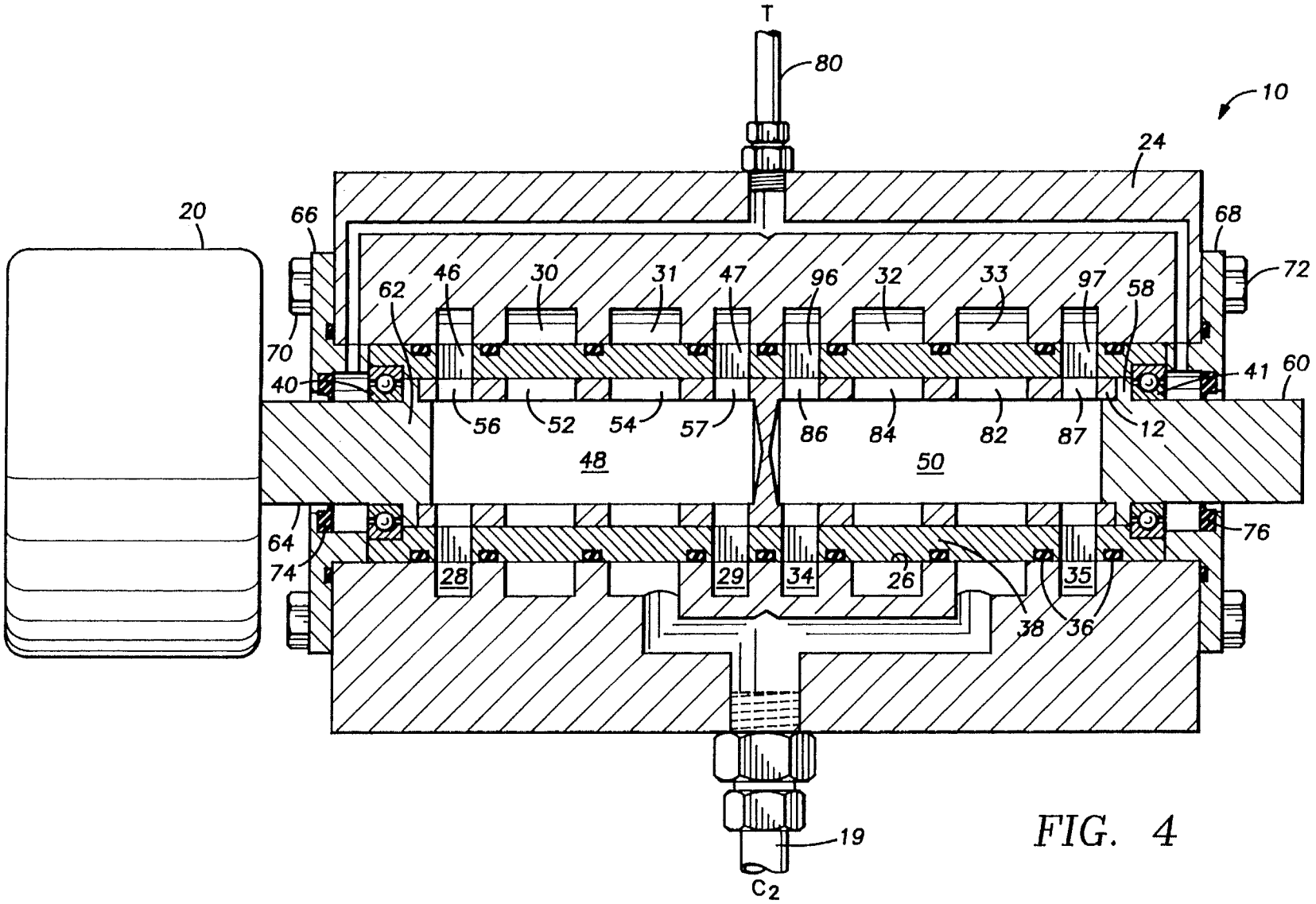
FIG. 4 is a detailed drawing of the structure of the essential parts of the servo valve along line 4—4 of FIG. 2.

FIG. 3 is a longitudinal cross section along line 3—3 of FIG. 2, of the servo valve of this invention generally shown as 10. FIG. 4 is a cross section along line 4—4 of FIG. 2. The mechanical details of the valve will now be explained with reference to both FIGS. 3 and 4.

Servo valve 10 is comprised of a valve body 24 having a cylindrical internal bore 26 drilled lengthwise therethrough. A plurality of annular chambers 28, 29, 30, 31, 32, 33, 34 and 35 are provided in bore 26 at selected spaced-apart locations therealong. By use of suitable plumbing, annular chambers 31, 33 provide fluid communication with actuator input port 19, chambers 30 and 32 provide fluid communication with actuator input port 21 while chambers 34, 35 and 28, 29 are connected respectively to pressure line 16 and return line 14. It should be understood that the direction of flow may be reversed from the flow direction recited above.

Figure 5:
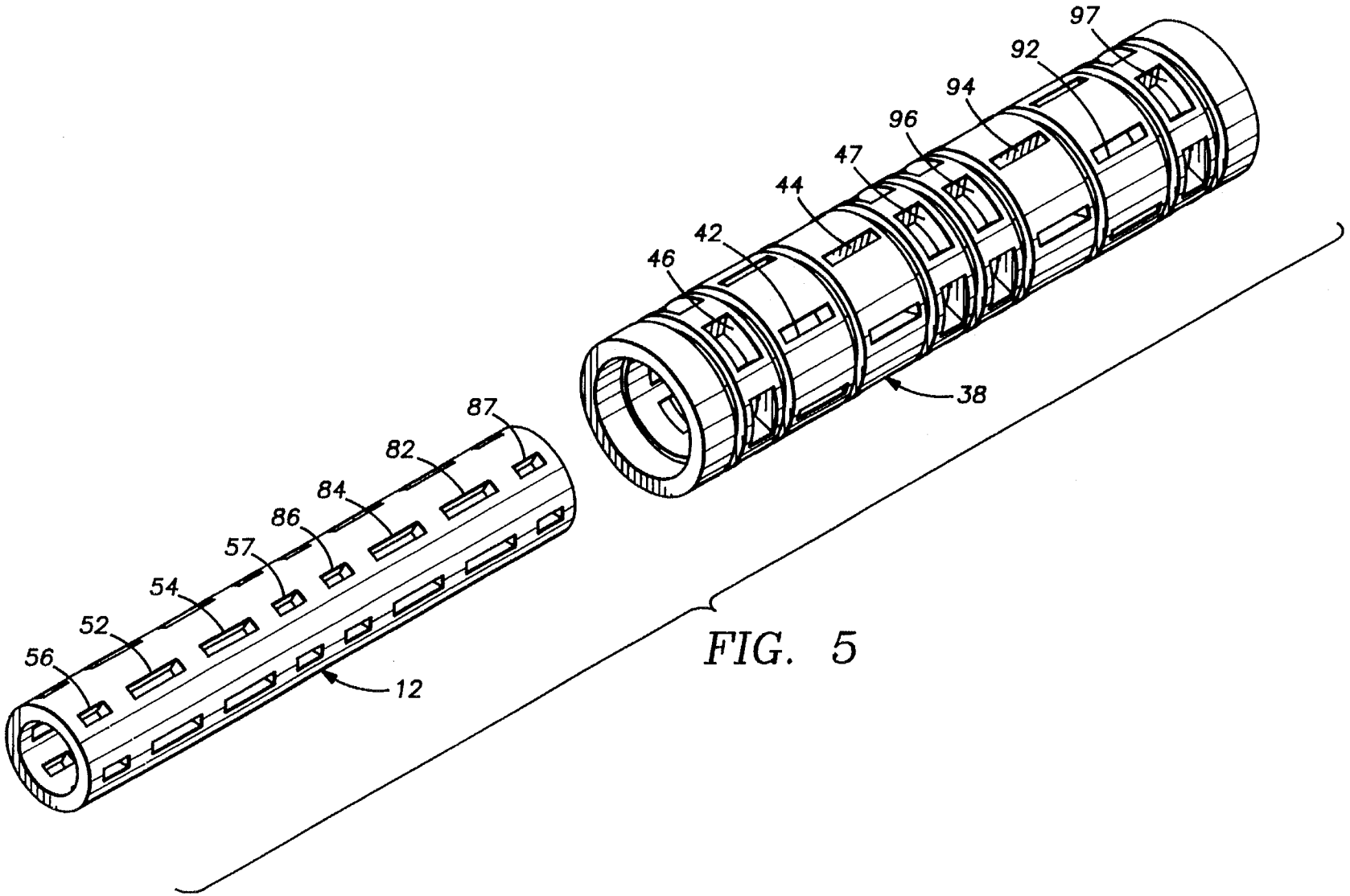
FIG. 5 is an exploded isometric view of the sleeve and control member that are mounted internally of the servo valve body.

A cylindrical sleeve 38 is mounted in bore 26 and held in place by any convenient means such as by end plates 66 and 68. O-rings such as 36 seal off the respective annular chambers from each other. Sleeve 38 includes a plurality of sets of ports that are distributed axially along sleeve 38, each set being so positioned as to correspond to the axial distribution of the respective annular chambers. Referring to FIG. 5, the individual ports of each set are distributed radially around the wall of sleeve 38 at desired angular intervals such as 60° by way of example but not by way of limitation. In the exemplary drawings of FIGS. 3, 4 and 5, the sets of ports are divided into two groups of at least three and preferably four sets of ports each, there being at least six ports to each set, again by way of example but not by way of limitation. The axial distribution of the ports is shown in FIG. 3 by the dashed rectangular outlines 42, 44, 46 and 47 which represent one port of each set of a first group of ports; the other ports of each set are not shown in FIG. 3 to avoid complicating the drawing. Similarly, in FIG. 4, only one set of ports and apertures of each group is identified. The outlines of the ports in sleeve 38 are shown as dashed lines because the control member 12, which fits inside sleeve 38 as shown in FIG. 5 and described later, is shown in the null position and hides the actual port outline.

Figure 8:
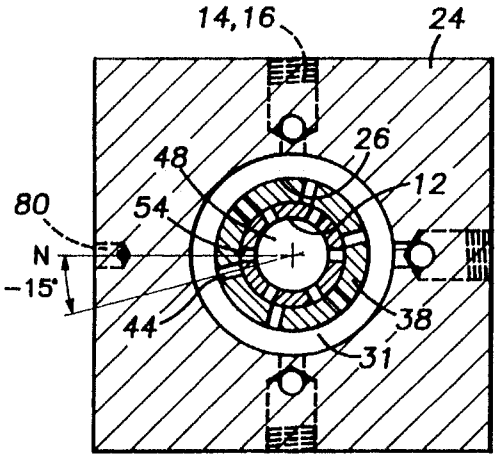
FIG. 8 is a cross section along line 8—8 of FIG. 3 showing the configuration of a second set of ports in the sleeve relative to the apertures in the control member when the control member is in the null position.
Figure 7:
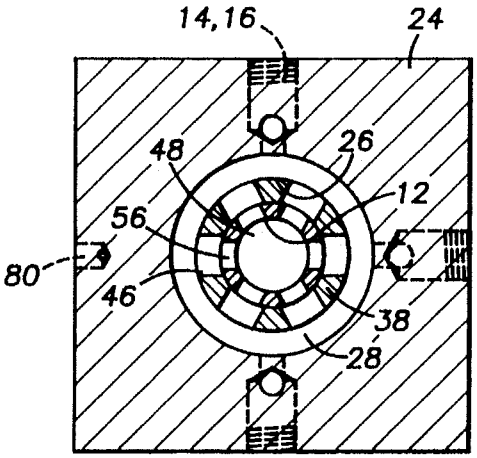
FIG. 7 is a cross section along line 7—7 of FIG. 3 showing the angular orientation of a third set of ports in the sleeve relative to a third set of apertures in the control member when the member is in the null position.
Figure 6:
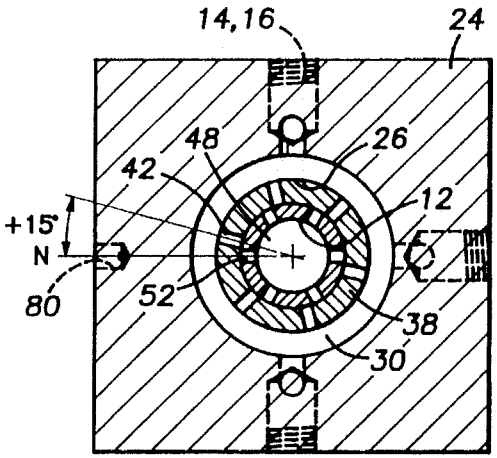
FIG. 6 is a cross section taken along line 6—6 of FIG. 3 showing the angular orientation of a first set of ports in the sleeve and a first set of apertures in the control member when the member is in the null position.

The radial distribution of the first, left-hand group of sets of ports in sleeve 38 are best shown in the isometric view of FIG. 5 and in FIGS. 6, 7 and 8 which are cross sections along lines 6—6, 7—7 and 8—8 of FIG. 3. The configuration of a second, right-hand group of sets of ports is substantially identical with the configuration of the first left-hand group. The configuration of port 47 is substantially identical to that of port 46.

There are a plurality of ports in each set in the sleeve. Similarly, as will be discussed later, the control member 12 includes plurality of apertures. Hereafter for brevity, an entire set of openings (ports or apertures) will be referred to by a single reference number designating a typical opening such as port 42 of FIG. 3.

Refer to FIG. 6 which shows the radial distribution of a first set of ports such as 42 in sleeve 38 which is mounted in bore 26 of valve body 24, the set of ports being positioned to correspond to the axial location of annular chamber 30. Six ports are shown but more or fewer could be provided. The ports have preselected dimensions that depend upon the number of ports in each set, the desired fluid flow rate through the ports and the pressure drop across the work load. Observe that the angular orientation of the central longitudinal axis of port 42 (FIGS. 3 and 6) is displaced 15° clockwise with respect to a null axis N.

A second set of ports is shown in FIGS. 3 and 8 which shows valve body 24, bore 26, sleeve 38 and a representative port 44. The second set of ports is aligned axially with annular chamber 31. The central longitudinal axes of the set of ports exemplified by port 44 are angularly rotated by a preselected angle such as 15° counterclockwise with respect to the null axis N. Thus, the radial orientation of the central longitudinal axes of a first set of ports within a first group is rotated by a preselected angular displacement with respect to the radial orientation of the central longitudinal axes of a second set of ports of that same group.

FIG. 7 shows a third set of ports within the first group. As before, sleeve 38 is shown mounted in bore 26 of valve body 24. The third set of ports, as represented by port 46 is positioned axially along sleeve 38 to correspond with the location of annular chamber 28. The radial dimensions of the ports of the third set of ports subtends an arc having a width sufficient to allow unrestricted fluid flow through the third set of control member apertures when the control member rotates between the first and second angular positions which in this example is on the order of 60°. The dimensioning and angular positioning of the fourth set of ports 47 is substantially identical to that of the third set 46. The axial position of the fourth set of ports corresponds to the location of annular chamber 29.

The configuration of the four sets of ports that make up the second, right-hand group of ports, is substantially identical with the configuration of the sets of ports of the first group, therefore a detailed description is not needed. That is, the radial orientation of the first, second, third and fourth sets of ports of the first group are angularly aligned respectively with the first, second third and fourth sets of ports of the second group; however, it should be observed that the first and second sets of ports of the second group of ports open into annular chambers 32 and 33 while the third and fourth sets of ports open into annular chambers 34 and 35.

A cylindrical fluid-flow control member 12 as seen in FIGS. 2, 3 and 5 is rotatably mounted within sleeve 38 and is held in place by any convenient means such as bearings 40 and 41 in combination with end plates 66 and 68. In FIG. 5, control member 12 is shown but for clarity is depicted without end caps 58, 62 and shafts 60, 64 attached thereto. Control member 12 is hollow and includes two separate internal elongated flow chambers 48 and 50, closed at both ends. Preferably, the diameter of the control member is less than one-fourth of its length. The wall of each flow chamber includes a plurality of sets of apertures, for example, at least three and preferably four sets each. The axial distribution of the sets of apertures along the control member corresponds to the axial distribution of the sets of ports in sleeve 38. That is, for every set of apertures in the control member, there is a corresponding set of ports in the sleeve member. The apertures of each set have preselected dimensions and are radially distributed symmetrically around the perimeter of the control member. The central longitudinal axes of the apertures may be in angular alignment with each other thereby to provide fluid communication with the internal flow chambers of the control member. The areal dimensions of the ports in the sleeve are at least as large as the preselected dimensions of the corresponding sets of apertures in the control member.

In an alternative arrangement, it is evident that the central longitudinal axes of the ports in the sleeve may be in angular alignment whereas the central longitudinal axes of the first set of apertures of each group may be rotated by a preselected angle with respect to the central longitudinal axes of the second set of apertures as shown in FIGS. 12–18.

The apertures in the rotary control member 12 are shown as being rectangular openings but they could be of some other shape such as round, triangular or elliptical. The areas of the respective openings depends upon the desired fluid flow rate. It is preferable that the diameter of control member 12 be kept as small as possible to minimize inertial effects. Therefore, for a small-diameter control member, the axial dimension of an aperture will be much greater than the chord of the angular arc subtended by the apertures. Similarly for the openings in the sleeve member. Thus, for a given fluid flow rate, the diameter of the control member may be traded off against increased length provided that the cross sectional area of the internal chambers of the control member is not so small as to be fluid-flow restrictive. As an alternative to a single relatively large clear opening, each aperture could be composed of a plurality of small orifices arranged in a desired pattern and having an aggregate area of the requisite size to handle the desired flow rate. That configuration could prove to be a viable manufacturing advantage. Small, in this context, means orifices having a diameter on the order of 0.75 to 1.5 mm.

Control member 12 is made from rod material of suitable diameter that has been drilled out from each end to form the internal flow chambers. An end cap 58 having a shaft portion 60 is welded to one end of the control member 12 and thereafter ground and polished to form flow chamber 50. Flow chamber 48 is closed by similarly welding an end cap 62 and shaft portion 64 to the other end of the control member. End cap 58 and shaft portion 60 have the same diameters respectively as end cap 62 and shaft portion 64 so that the forces on the opposite ends of the control member will be equalized. As earlier stated, control member 12 is inserted inside sleeve 38. The control member is inhibited from axial motion by bearings 40 and 41 which are, in turn held in place by end plates 66 and 68. End plates 66 and 68 may be fastened in place by bolts such as 70 and 72. Rotary pressure seals 74 and 76 of any desired type seal in any fluid leakage from around the bearing races. A conduit 80 provides a means for draining accumulated leakage. Conduit 80 may be coupled to either the pump return or to the system reservoir which is at atmospheric pressure. Conduit 80 may be integral with the valve body or it may be an external pipe line.

As before explained, programmable motor 20, under control of a controller 22 of any desired type, rotatably reciprocates the control member 12 between a preselected first and a second discrete angular orientation relative to a null position.

Figure 11:
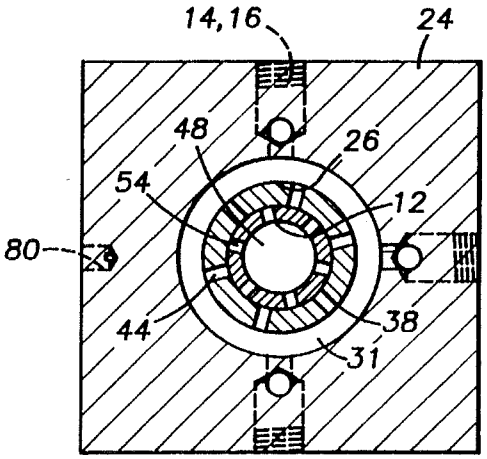
FIGS. 9, 10, 11 are cross section corresponding respectively with FIGS. 6, 7, 8 wherein control member 12 has been rotated 15° clockwise.
Figure 10:
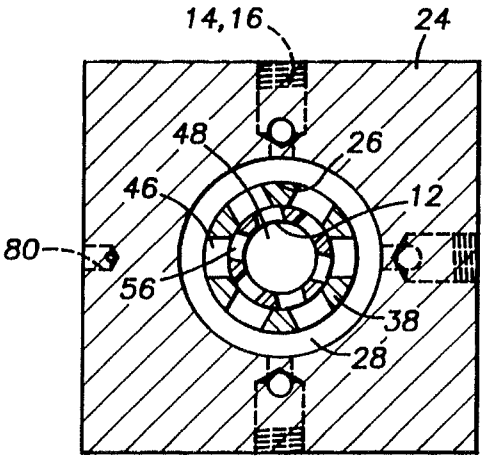
Figure 9:
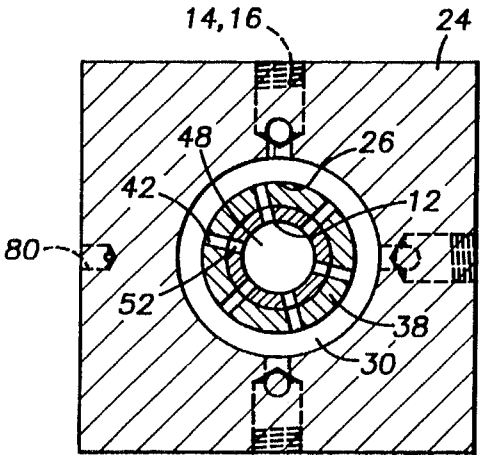
Figure 12:
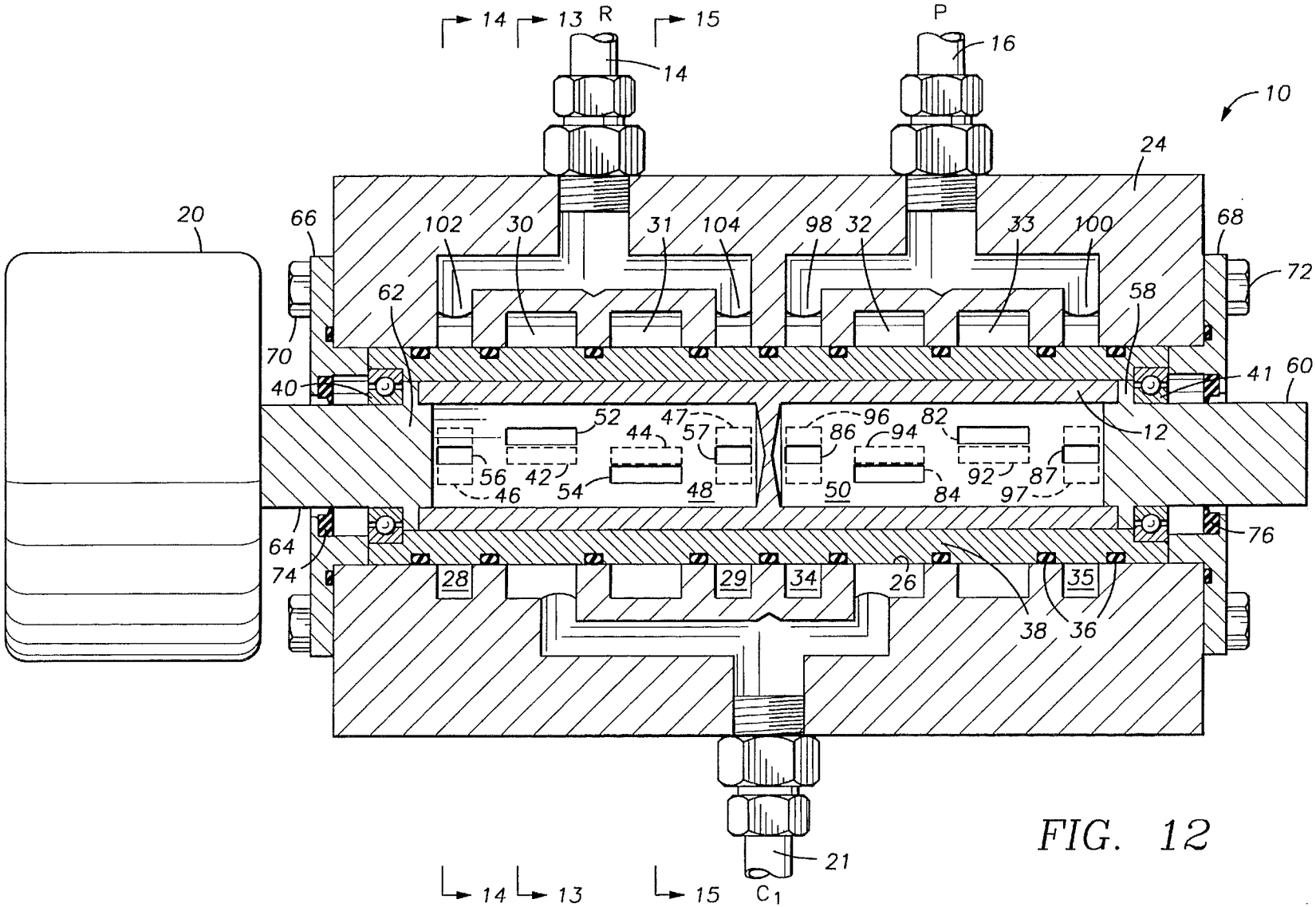
FIG. 12 is an exploded isometric view, comparable to FIG. 5, of an alternate configuration of the ports and apertures of the sleeve and control member.
Figure 13:
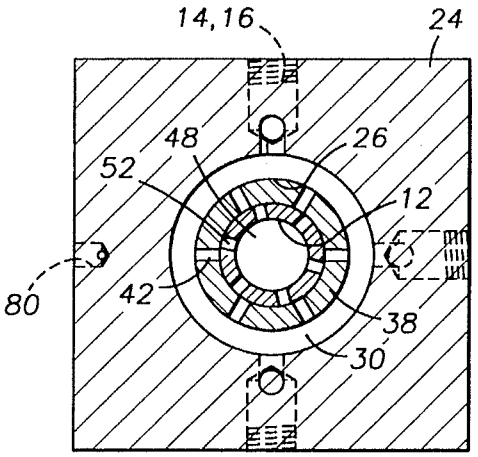
FIGS. 13, 14, 15 are cross sections along lines 13—13, 14—14, and 15—15 of FIG. 12.
Figure 14:
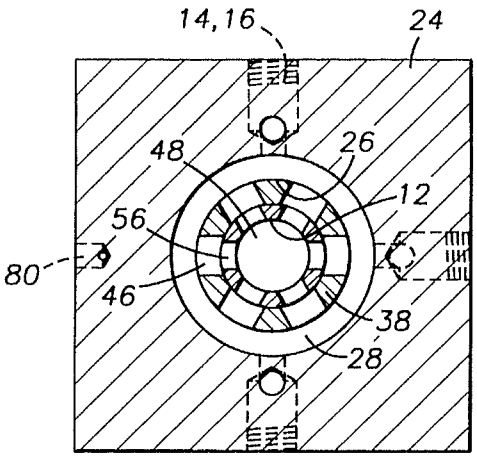
Figure 15:
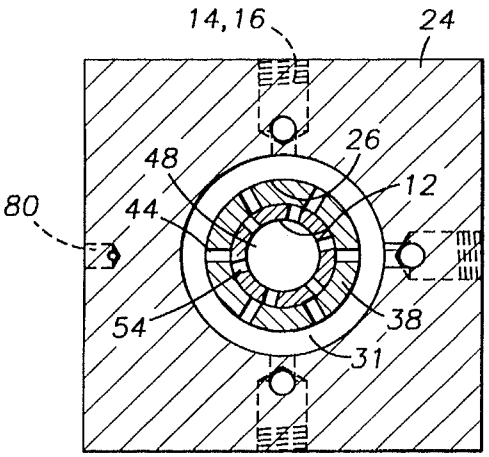
Figure 16:
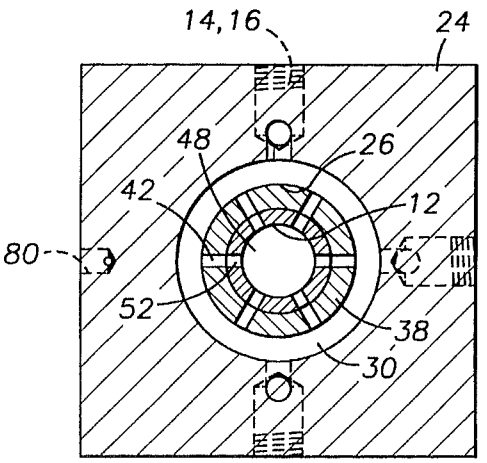
FIGS. 16, 17, 18 are cross section corresponding respectively with FIGS. 13, 14, 15 wherein the control member has been rotated clockwise by 15°.
Figure 17:
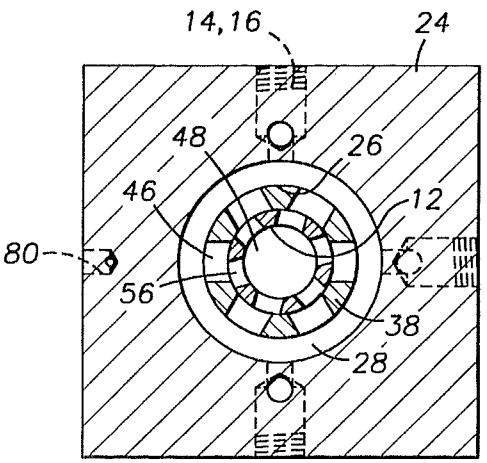
Figure 18:
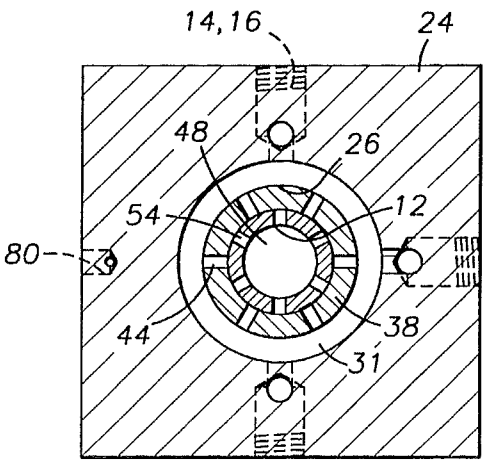

With respect to operation, the valve as shown in FIGS. 3–8 is in the null position. That is, when apertures 52 and 54 of control member 12, FIG. 6, are aligned with the null axis N, ports 42 and 44 are blocked. FIGS. 9–11 are the cross section of FIGS. 6–8 except that the control member 12 has been rotated 15° clockwise. With control member 12 rotated 15° clockwise, aperture 52 and all the other apertures in the first set in control member 12 are open to port 42 and all of the other ports of the first set in sleeve 38. All of the ports in the second set of ports in sleeve 38 are blocked. Because of the large arc width subtended by the apertures 56 and 57 and ports 46 and 47 in the third and fourth sets, as shown in FIGS. 7 and 10, the ports are always open and flow chamber 48 is always open to the return line 14 through annular chambers 28 and 29. In a similar fashion, flow chamber 50 is always open to the pressure line 16 through apertures 86 and 87, through ports 96 and 97 to annular chambers 34 and 35.

Referring to FIGS. 3, 4 and 9–11 collectively, with apertures 52 and 82 aligned with ports 42 and 92, pressurized fluid flows into flow chamber 50 from pressure line 16 via annular chambers 34 and 35, through ports 96 and 97, apertures 86 and 87 and out to actuator 18 via aperture 82, port 92, annular chamber 33 and output line 19. Fluid is exhausted from the left end of the actuator through line 21, annular chambers 30, through port 42 and aperture 52, into flow chamber 48 and thence out to the return line 14 through apertures 56 and 57, ports 46 and 47 and annular chambers 28 and 29. Apertures 54 and 84 are blocked.

When the control member is rotated 15° counterclockwise relative to the null axis N, aperture 84 opens port 94 to apply pressure to input port 21 while aperture 54 opens port 44 so that the fluid being exhausted from input port 19 will be directed to the return circuit via flow chamber 48 and annular chamber 28 and 29. As pointed out earlier, the valve 10 may be operated with the fluid flow in the reverse directions.

In this disclosure, the preferred dual-feed configuration of the rotary servo valve has been described. In this configuration, dual feed lines 98 and 100 and dual return lines 102 and 104 are coupled to chambers 50 and 48 respectively through ports 96, 97 and ports 46, 47 respectively. It is of course possible to use a single pressure line and a single exhaust or return line by simply eliminating the fourth set of ports and apertures. Eliminating the fourth set of ports and apertures would simplify the manufacture of the valve but would most likely compromise valve performance especially if the diameter of the internal chamber of the control member already limits the maximum valve fluid flow rate that can be achieved. Elimination of the fourth set of ports and apertures may necessitate an increase in the diameter of the interior chamber of the control member by a factor of as much as 1.414 to achieve the same effective cross sectional area as would be had by the same member but equipped with a dual feed capability. That would most likely make necessary an increase in the outside diameter of the control member, resulting in an undesirable increase in controlmember inertia. Hence, although a single feed and exhaust configuration is not ruled out as a useful embodiment, the dual-feed configuration is a preferred compromise.

The preferred embodiment has disclosed the rotary control member to be characterized by two chambers. The valve could be provided with only a single chamber for use as three way valve.

The control member could also be provided with three or more chambers if it were desired to control more than one load or to provide parallel operation.

The supply and return lines are coupled to the interior chambers of the control member via a series of radially-disposed ports. There is no reason why suitable orifices should not be provided in the end caps 58 and 62 thereby to allow axial supply-fluid and exhaust-fluid communication rather than radial fluid communication. In that configuration, the bearing, motor-coupling, rotary seal and support system would be suitably modified and the third and/or fourth sets of ports and apertures would not be needed.

This invention has been disclosed using by way of example but not by way of limitation with reference to the application of the valve to seismic vibrators. The rotary servo valve of this invention may also be beneficially used in the aircraft industry or the heavy machinery industries. Another application resides in the use of the servo valve with large horizontal shaker tables that are used for vibration testing of large assemblies.

In the drawings, portions of the supply and exhaust lines are shown to be integral with the valve body. Some or all of those lines may of course be externally plumbed.

The rotary servo valve has been described with a considerable degree of specificity by way of example but not by way of limitation. Those skilled in the art will conceive of variations in the design of the valve as above recited but which will lie within the scope and spirit of this invention which is limited only by the appended claims.

What is claimed is:

1. In a low inertia servo valve including a valve body having an internal cylindrical bore, said bore including a plurality of annular chambers therearound, said annular chambers being distributed axially at selected locations along said bore, said annular chambers comprising means for fluid communication with, respectively, a pressurized fluid source, a fluid return and the fluid input and fluid output ports of a fluid-driven actuator device, the improvement comprising:

a sleeve mounted within said bore, said sleeve including at least two groups of at least three sets of ports per group, said sets of ports being distributed axially along said sleeve, the ports that comprise each said set having preselected areal dimensions, are radially distributed around the perimeter of said sleeve, opening into corresponding annular chambers, the angular orientation of those ports that comprise a first set of ports within each group being rotated by a preselected angular displacement with respect to the angular orientation of a second set of ports within each group;

a fluid-flow control member rotatably mounted within said sleeve, said control member including at least a first and a second internal elongated chamber each for containing respectively first and second groups of at least three sets of apertures, the axial distribution of the respective groups of sets of apertures along said control member corresponding to the axial distribution of the groups of sets of ports along said sleeve, the apertures of each said set, having preselected areal dimensions, are radially disposed around the perimeter of said control member, the angular orientations of a first and a second set of apertures in each group being in angular alignment;

a control member drive means for rotatably reciprocating said control member between a first and a second angular position relative to a null position; and in each group in said sleeve, a third set of ports that are dimensioned radially such that the angular opening of each port of said third set of ports of each group subtends an arc having a width sufficient to ensure unrestricted fluid flow through a third set of control-member apertures as the control member rotates between the first and second angular positions.

2. The servo valve as defined by claim 1, wherein:

said sleeve defines two groups of four sets of ports and said control member defines two groups of four sets of apertures, the radial dimensions of the fourth sets of ports being substantially identical to radial dimensions of said third sets of ports of each groups, the radial dimensions of the fourth sets of apertures being substantially identical to the third sets of apertures of each group.

3. The servo valve as defined by claim 1 wherein:

said first and second sets of apertures are comprised of a plurality of small orifices arranged in a desired pattern.

4. The rotary servo valve as defined by claim 1 wherein said first preselected angular displacement is non-zero.

5. The servo valve as defined by claim 4, wherein:

the ports of the third set of said first group are in fluid communication with a source of pressurized fluid via a first annular chamber and the ports of third set of said second group are in fluid communication with a fluid return via a second annular chamber.

6. The servo valve as defined by claim 5, wherein:

the apertures of the third set of said first group provide free-flow fluid communication between a first chamber internal to the control member and said source and the apertures of said second group provide free-flow fluid communication between a second chamber internal to the control member and said return, regardless of the angular orientation of said control member.

7. The servo valve as defined by claim 4, comprising:

means for programming the angular positioning of said control member drive means.

* * * * *